United States Patent [19]

Whigham et al.

[11] Patent Number: 5,062,555

[45] Date of Patent: Nov. 5, 1991

[54] MICROPROCESSOR BASED RATIO ADJUSTMENT AND PORTION CONTROL SYSTEM FOR POSTMIX BEVERAGE DISPENSING VALVES

[75] Inventors: Roger C. Whigham, Atlanta; George H. Hoover, Marietta, both of Ga.

[73] Assignee: The Coca-Cola Company, Atlanta, Ga.

[21] Appl. No.: 332,644

[22] Filed: Apr. 3, 1989

[51] Int. Cl.[5] ..... G04C 1/12

[52] U.S. Cl. ..... 222/641; 222/129.4; 137/624.12

[58] Field of Search ..... 222/641, 129.4, 129.3, 222/638, 145; 137/624.13, 624.12, 624.18

[56] References Cited

U.S. PATENT DOCUMENTS

| | | | |
|---|---|---|---|
| 2,982,446 | 5/1961 | Liolios et al. | 222/145 |
| 3,823,846 | 7/1974 | Probst | 222/641 |
| 4,282,987 | 8/1981 | Thomas et al. | 222/641 |
| 4,293,008 | 10/1981 | Coleman | 141/95 |
| 4,537,336 | 8/1985 | Verdnia et al. | 222/641 |

FOREIGN PATENT DOCUMENTS

| | | | |
|---|---|---|---|
| 2101088 | 1/1983 | United Kingdom | 222/641 |

*Primary Examiner*—Robert P. Olszewski
*Assistant Examiner*—Kenneth Noland
*Attorney, Agent, or Firm*—Thomas R. Boston; W. Dexter Brooks

[57] ABSTRACT

A microprocessor based control system including an electrical unit attached to a postmix beverage dispensing valve for performing the three functions of: portion control, reminding the operator to check the ratio, and adjusting the ratio. The portion control operation can be identical to known portion control devices. The reminder function can turn on a light every two weeks, for example. In the ratio adjusting function, the operator puts a single cup under the valve, pushes "Small" to dispense syrup for a predetermined time period which should result in the dispensing of a predetermined volume of syrup, measures the exact volume actually dispensed, and then adjusts the syrup flow control accordingly until the exact predetermined volume is dispensed, and repeats the operation for water in the same cup but to a different predetermined volume. The flow rate can accurately be set at the same time as the ratio.

2 Claims, 9 Drawing Sheets

MICROPROCESSOR BASED RATIO ADJUSTMENT AND PORTION CONTROL SYSTEM FOR POSTMIX BEVERAGE DISPENSING VALVES

BACKGROUND OF THE INVENTION

This invention relates to postmix beverage dispensing valves and in particular to a microprocessor based unit for attachment to such valves for providing ratio adjustment, portion control, and a reminder to chech the ratio.

Previously, multi-chambered cups have been used to measure the ratio of syrup to water in a postmix beverage dispensing system. These multi-chambered cups are normally used in connection with a common, well-known syrup separator such as the syrup separator disclosed in U.S. Pat. No. 2,982,446 to Liolios et al. A form of this multi-chambered cup is shown as syrup graduate 142 in FIG. 8 of the Liolios et al patent.

In the multi-chambered cup graduates of the type disclosed in the Liolios et al patent, a separated graduate must be provided for each syrup ratio. The syrup is adjusted to the correct ratio by adjusting the dispensing nozzle until the water and syrup levels are equal. One disadavntage of this system is the need to provide a different graduate for each water/syrup ratio.

This problem was corrected in another type of prior art graduate, also of the multi-chambered cup type, which has ratio graduations imprinted on one fluid chamber into which syrup is disposed and a water-level line imprinted on the other fluid chamber into which water is dispensed. Thus, the operator could fill the water chamber to a perdetermined level and then read the water/syrup ratio from one of a series of syrup ratio graduations which corresponds to the level of the syrup in the syrup chamber.

One problem with this type of system is that it is difficult to determine the accuracy of the measurement. Also, it is difficult for the operator to turn off the water and syrup at precisely the proper moment to align the water level with the water-level line.

SUMMARY OF THE INVENTION

It is a primary object of the present invention to provide an improved system for adjusting ratio in postmix beverage dispensing valves, and which will also serve as the portion control and will additionally remind the operator to check the ratio.

It is another object to provide an easy way to adjust the ratio.

It is a further object to adjust ratio without the need to first install a syrup separator.

It is a still further object to adjust ratio without reducing flow rate and to accurately set the flow rate at the same time.

It is another object to adjust ratio without wasting syrup.

It is a still further object to adjust ratio using only one volume cup for all ratios.

These and other objects of this invention are achieved by use of a microprocessor based unit that can be attached to a postmix beverage dispensing valve either as OEM equipment or as a retrofit. The unit can fit inside the valve cover and can operate on the 24VAC commonly available in fountain-dispensers. It can be retrofit on exsisting valves and performs the three functions of: portion control, a reminder to check ratio, and as an easy way to adjust the ratio.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
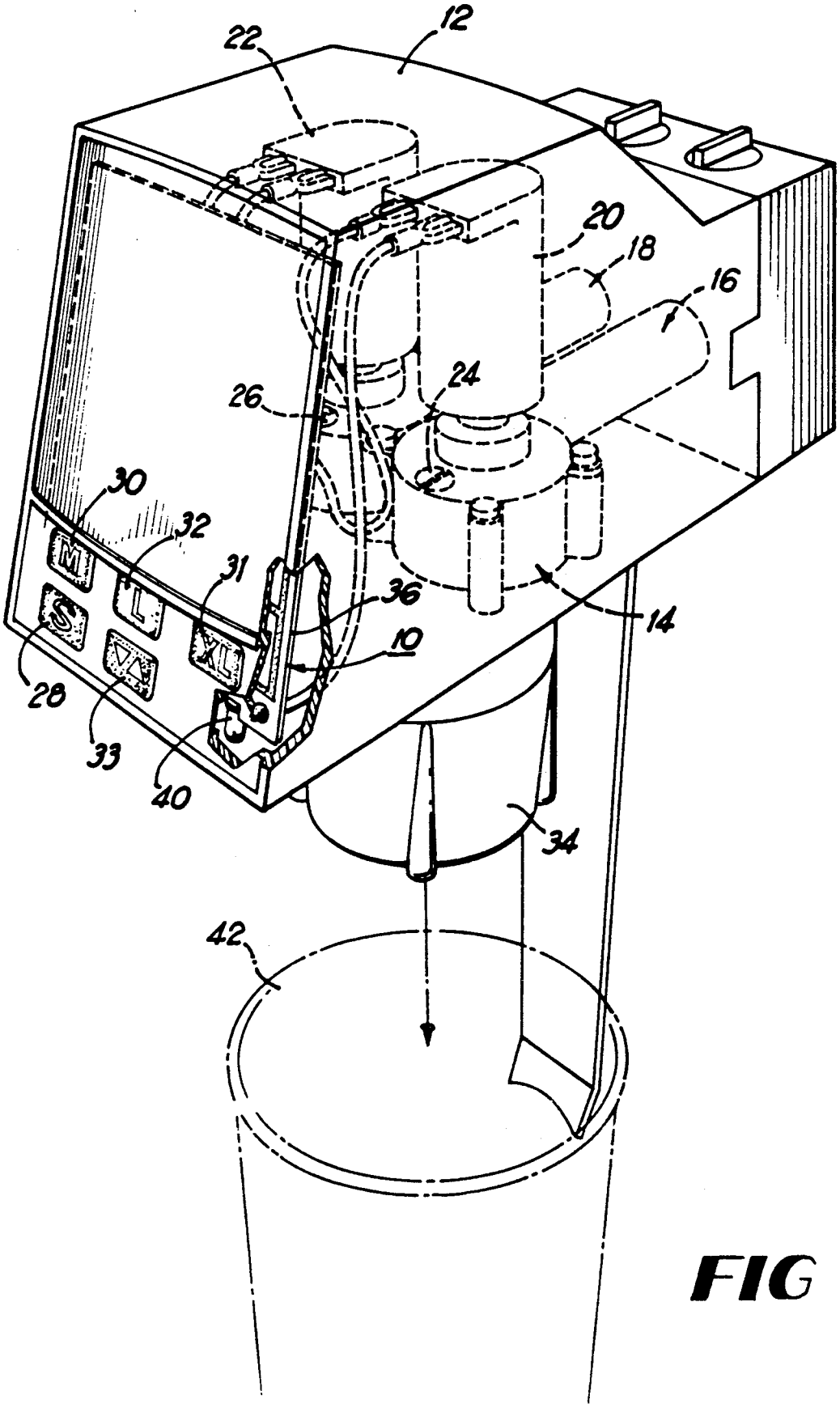
FIG. 1 is a partly broken-away perspective view of a standard postmix valve showing the unit of this invention installed thereon.

With reference now to the drawings, the system of this invention includes an electrical control 10 that can fit inside of a valve cover 12 of a postmix beverage dispensing valve 14. The valve 14 includes a water circuit 16, a syrup circuit 18, a water solenoid 20, a syrup solenoid 22, water and syrup flow controls 24 and 26, respectively, small, medium, large, extra large, and pour/cancel buttons 28, 30, 32, 31 and 33 respectively, and a nozzle 34.

The control 10 is a microprocessor based device which obtains its operating power from the 24VAC which is commonly available in fountain dispensers. It can be retrofit on existing valves, such as a fast flow valve and will perform the three functions of portion control, reminder to check ratio, and ratio adjustment.

The control 10 serves at the portion control for the valve 14. Its operation as a portion control is identical to the operation of known portion control devices currently available with the following features:

a. Portion sizes (dispensing times) are taught to a controller 36 by getting into the program mode and dispensing a correct size drink;

b. The portion control can be taught to perform a timed, top-off routine.

The control 10 reminds the operator every one or two weeks to check the ratio. A timer, called the "prompt timer," is implemented in the software of the control microprocessor U2. It runs as long as power is connected to the unit. Every fifteen minutes the "prompt timer" stores its current valve in the non-volatile memory of the microprocessor U2. When a power failure occurs, the value in the "prompt timer" itself is lost. When power is restored, the "prompt timer" begins timing from the last value that was stored in the non-volatile memory.

When the control 10 is installed, switch #4 on DIP switch #SW3 is set in the ON position if the customer wants to be prompted every week to check the ratio. If the customer wants to be prompted every two weeks to check the ratio, switch #4 on DIP switch #SW3 is set in the OFF position. The "calibrate" light D3 which is visible to the operator at the location 40 shown in FIG. 1 on the front panel of the valve cover 12, is turned on by the microprocessor U2 and buffer U1A, when the "prompt timer" value is greater than on week or two weeks depending upon the setting of switch #4 on DIP switch #SW3.

The microprocessor U2 turns off the "calibrate" light and resets the "prompt timer" when the operator performs a ratio check as described below.

The control 10 provides an easy way to adjust the ratio of the dispensing valve 14.

When the operator presses the "Small" button 28 (or SW6), the large button 32 (or SW8), and the "Pour/-Cancel" button 33 (or SW1) simultaneosuly, the control 10 goes into the "Check Ratio Mode."

While in the "Check Ratio Mode," if the operator presses the "Small" button 28, the microprocessor U2 will turn on the syrup soleniod valve 22 for a calculated period that should allow two ounces of syrup to be delivered through the nozzel 34. The operator can measure the actual syrup dispensed into cup 42 and adjust the syrup flow control 26 accordingly so that two ounces are delivered.

When the large button 32 is pressed, while in the "Check Ratio Mode," the microprocessor U2 will turn on the water solenoid 20 for a calculated period of time that should allow ten ounces of water to be delivered. The operator can measure the actual water dispensed in cup 42 and adjust the water flow control 24 accordingly so that ten ounces of water are delivered.

The calculated time to turn on the water and syrup solenoids is based on the desired flow rate and the desired mixture ratio. The formula is:

$$\text{seconds to dispense 2 ounces of syrup} = \frac{2\ (\text{Ratio} + 1)}{\text{Flowrate}}$$

$$\text{seconds to dispense 10 ounces of water} = \frac{10\ \text{Ratio} + 1)}{\text{Ratio} \times \text{Flowrate}}$$

Where

Ratio=desired volume ratio of water to syrup

Flowrate=desired drink flow rate in ounce per second

The desired ratio is set by the operator at installation with switches 1 through 4 on DIP switch SW4. When switch 1 is ON and switches 2, 3, and 4 are OFF, the ratio is set for 4.75:1. When switch 2 is ON and switches 1, 2 and 4 are OFF, the ratio is set for 5:1. When switch 3 is On and switches 1, 2, and 4 are OFF, the ratio is set to 5.25:1. When switch 4 is ON and switches 1, 2, and 3 are OFF, the ratio is set for 5.5:1.

The desired flow rate is set by the operator at installation with switches 1 through 3 on DIP switch SW3. When switch 1 is ON and switches 2 and 3 are OFF, the flow rate is set for 2 ounces/second. When switch 2 is ON and switches 1 and 3 are OFF, the flow rate is set to 2.5 ounce/second. When switch 3 is On and switches 1 and 2 are OFF, the flow rate is set for 3 ounce/second.

When both the water and syrup have been checked, the prompt timer is reset.

Using this method to adjust the ratio and flow rate has several advantages over the conventional method. For example, it is not necessary to install a syrup separator to check the ratio. The use of such a separator can change the valve's behavior causing inaccurate adjustment.

Also, the flow rate is accurately set at the same time as the ratio.

In addition, syrup isn't wasted while the water flow is being adjusted.

Also, only one volume cup is needed for all ratios.

Figure 2A:
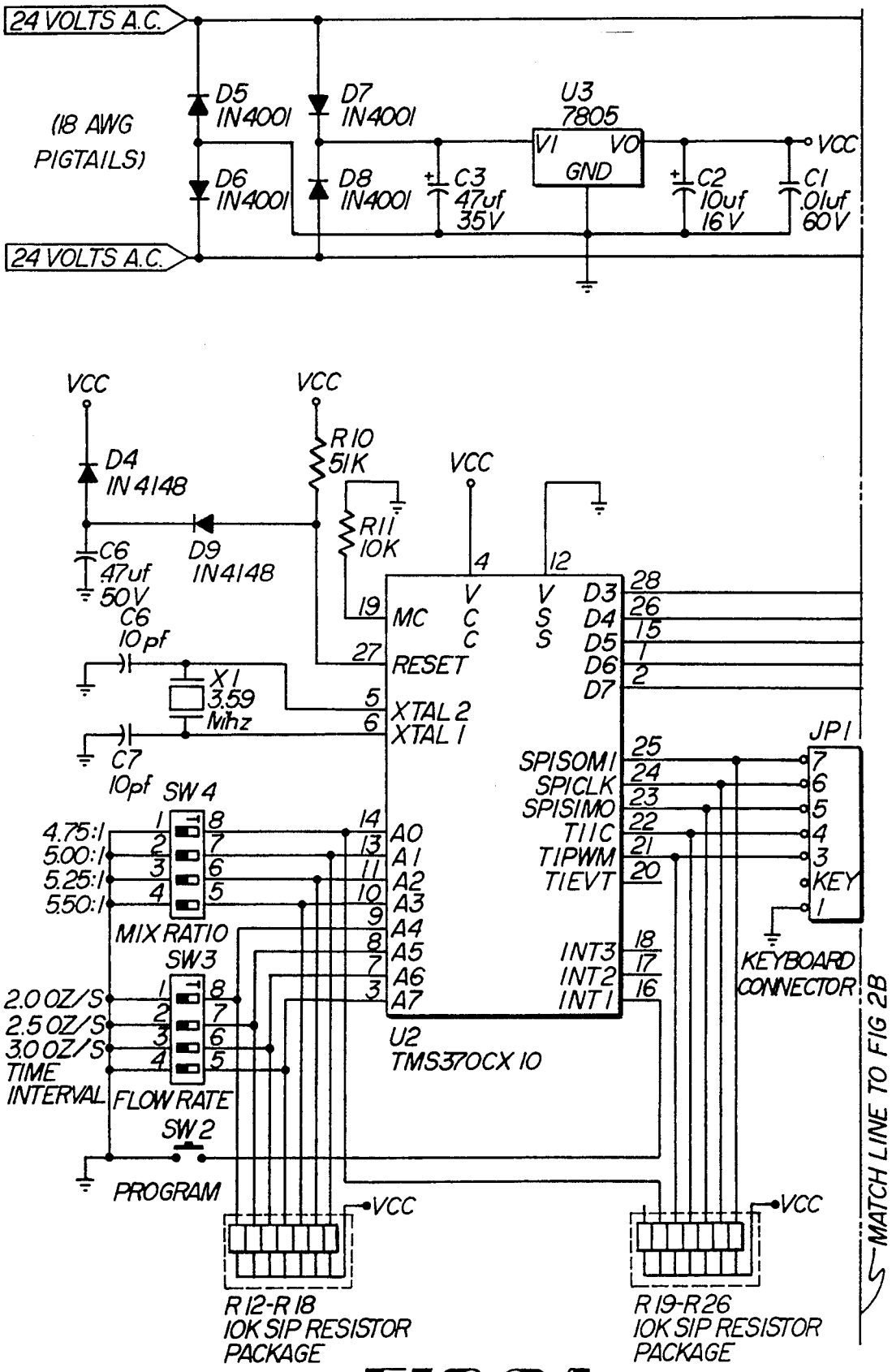
FIG. 2A and 2B is an electrical schematic of the circuit used in the present invention.
Figure 2B:
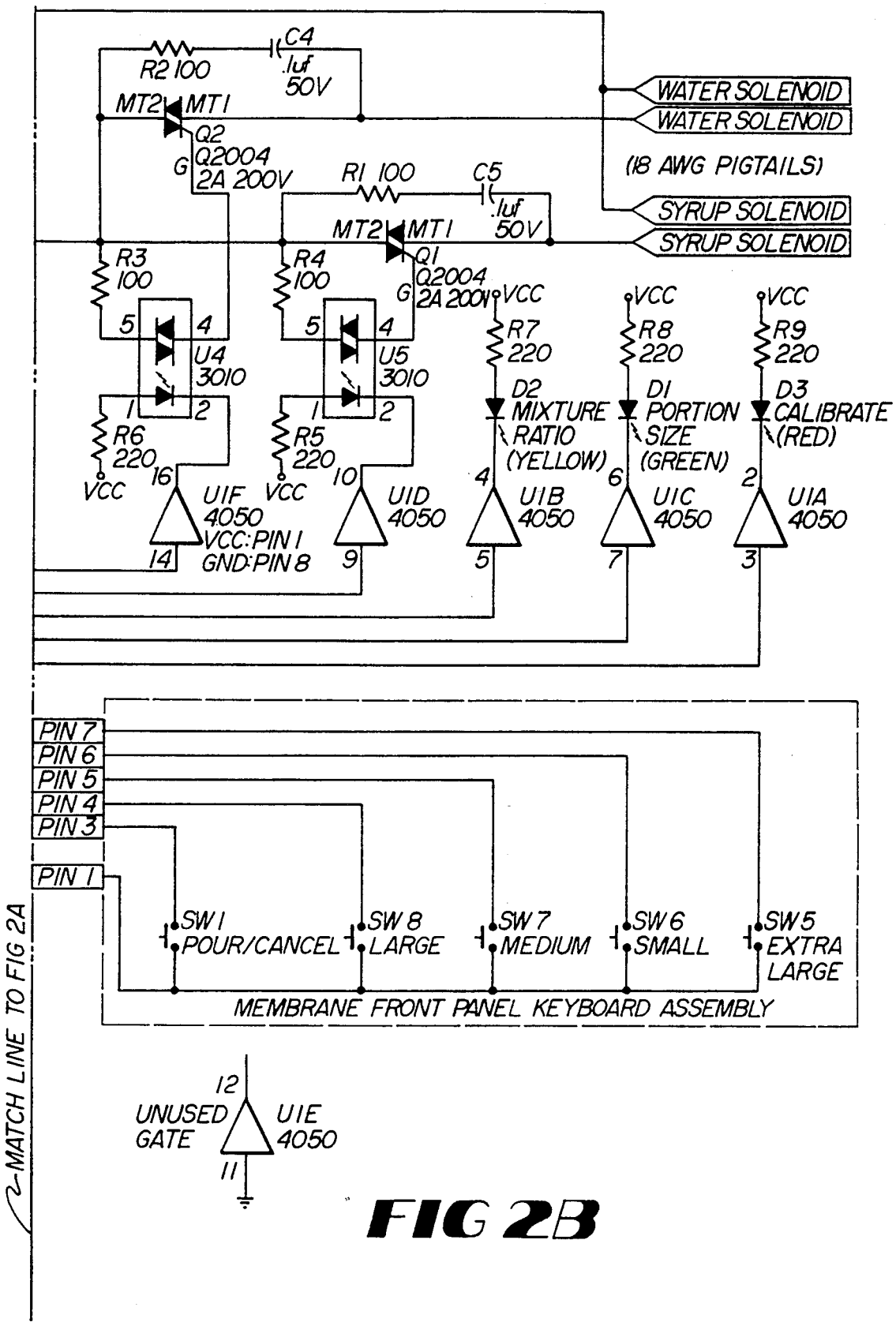

FIG. 2 shows the microprocessor U2, the five operating buttons on the front panel of the valve cover 12, namely, the pour/cancel button 33 (SW1), the large button 32 (SW8), the medium button 30 (SW7), the small button 28 (SW6), and the extra large button 31 (SW5).

FIG. 2 also shows the water and syrup solenoids 20 and 22, respectively.

The circuit of FIG. 2 operates as follows: Twenty four volts AC is provided to diodes D5, D6, D7 and D8 which act as a full wave bridge rectifier providing approximately 35 VDC to capacitor C3 which filters the pulsating DC. Integrated circuit U3 regulates the 35 VDC to 5 VDC which is the logic supply voltage to the circuit.

Diodes D4 and D9, resistor R10, and capacitor C8 are used to hold the reset line low on the microprocessor U2 until the 5 V logic supply is within tolerance.

The microprocessor U2 scans switches SW1 through SW8 for inputs. The microprocessor controls the value solenoids through buffers UIF and UID which drive opto isolators U4 and U5 respectively. Opto isolators U4 and U5 control triacs Q2 and Q1, respectively, which control power to the syrup and water solenoids. The microprocessor also controls indicator lights D1 through D3 through buffers UIC, UIB, and UIA respectively.

Figure 3:
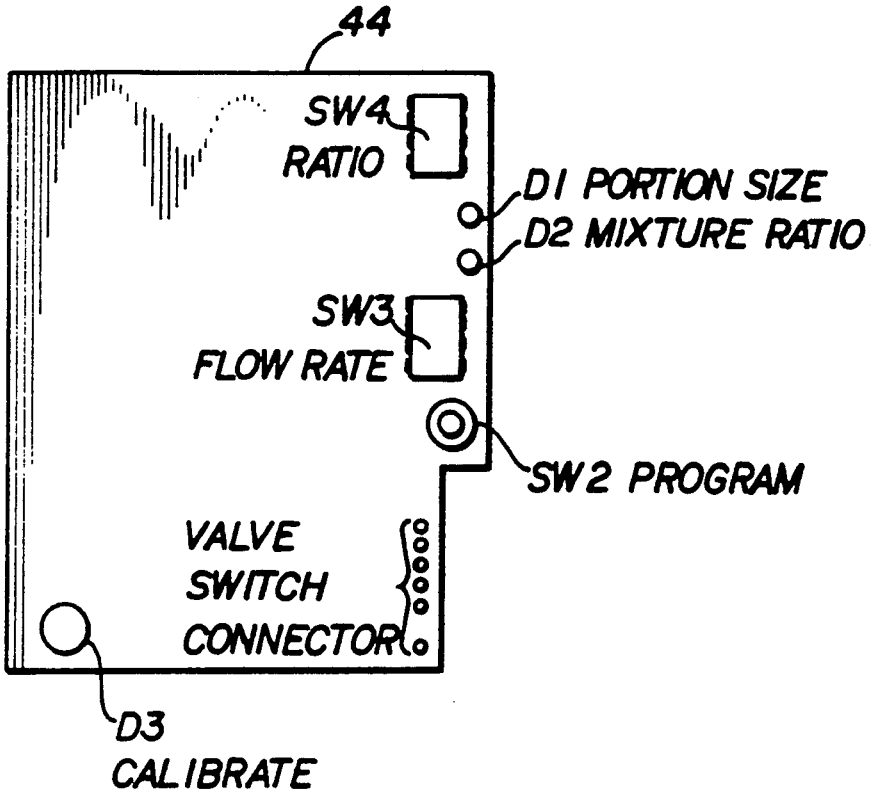
FIG. 3 is a plan view of the circuit board used in this invention.
Figure 4:
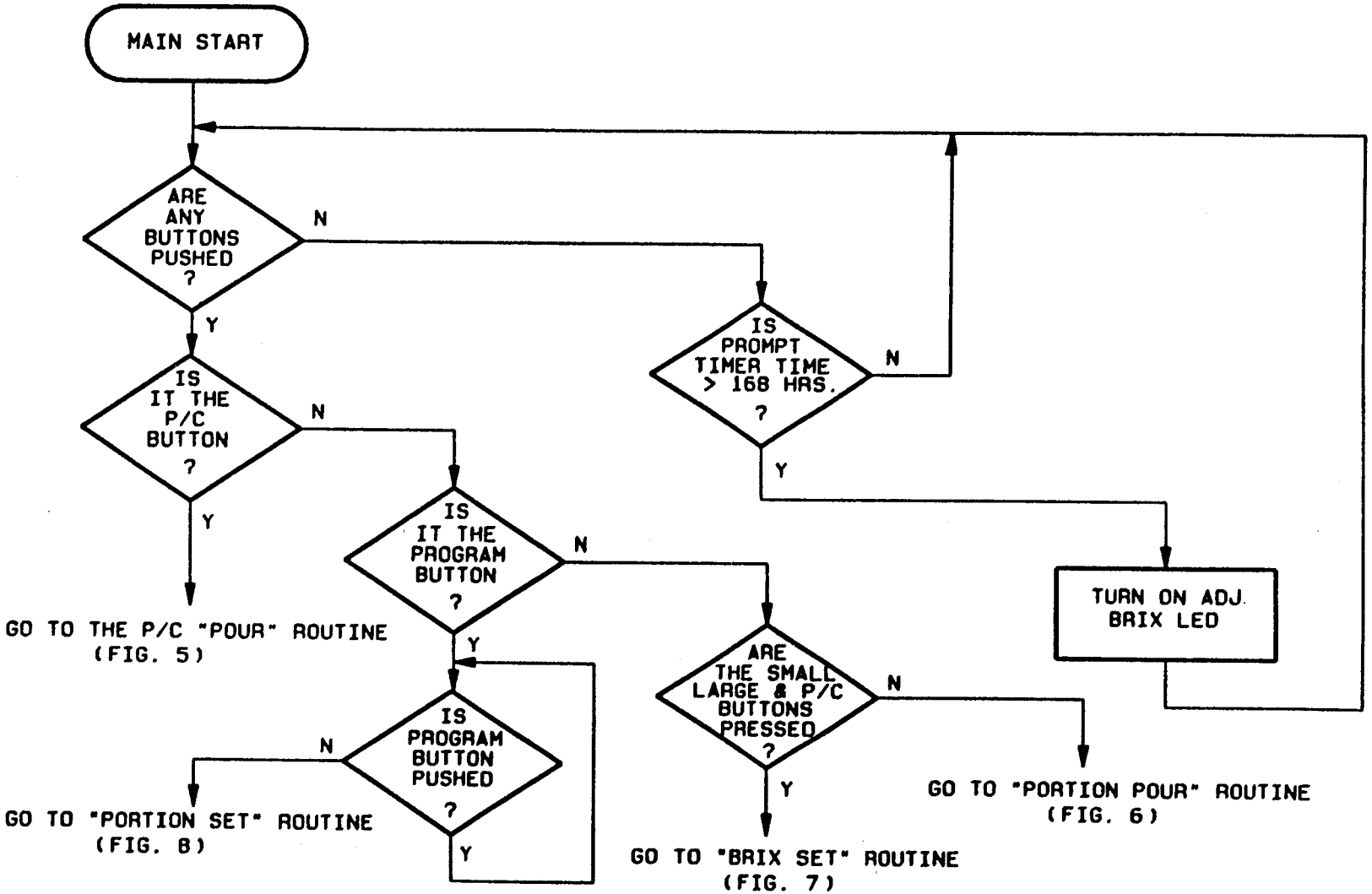
FIGS. 4, 5, 6, 7A, 7B and 8 are a flow chart of the software program used in this invention.

FIG. 3 shows the component side of the circuit board 44 which is located inside the front panel of the valve cover 12 as shows in FIG. 1. The circuit board includes all of the components shown on the schematic diagram (FIG. 2) except push buttons switches SW1, SW8, SW7, SW6, and SW5 which are located on the front of valve cover 12.

The operation of the control system of the present invention can best be understood by reference to FIGS. 4–8 which are a flow chart of the control system. Referring to FIGS. 4–8, FIG. 4 shows the main program which scans the keyboard and monitors the prompt timer. Once a key is pressed, control is transferred to another sheet depending upon the key that is pressed.

Figure 5:
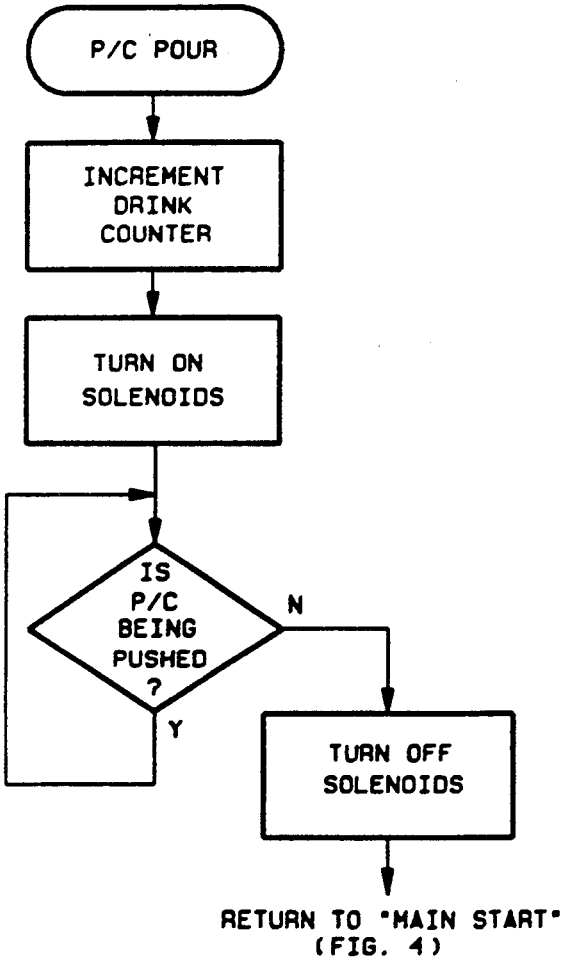

FIG. 5 shows the operation of the unit when the Pour/Cancel button SW1 is used to pour a drink. Once the Pour/Cancel button SW1 is released control is transferred back to the Main program in FIG. 4.

Figure 6:
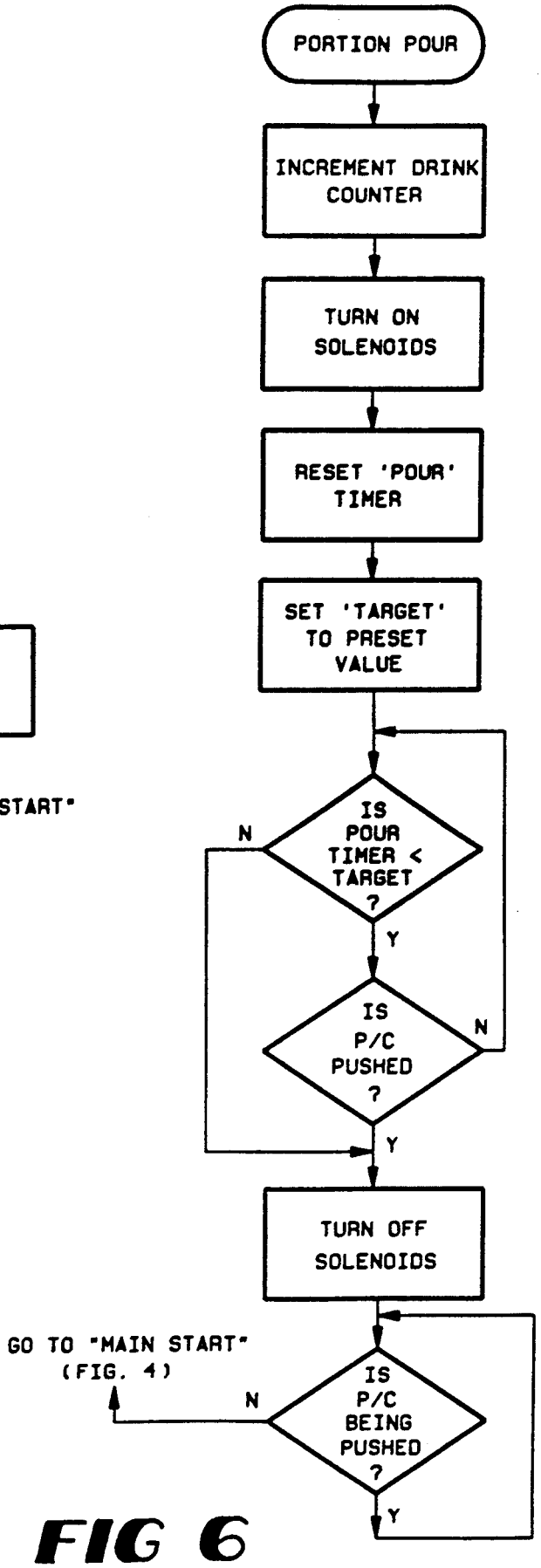
Figure 7A:
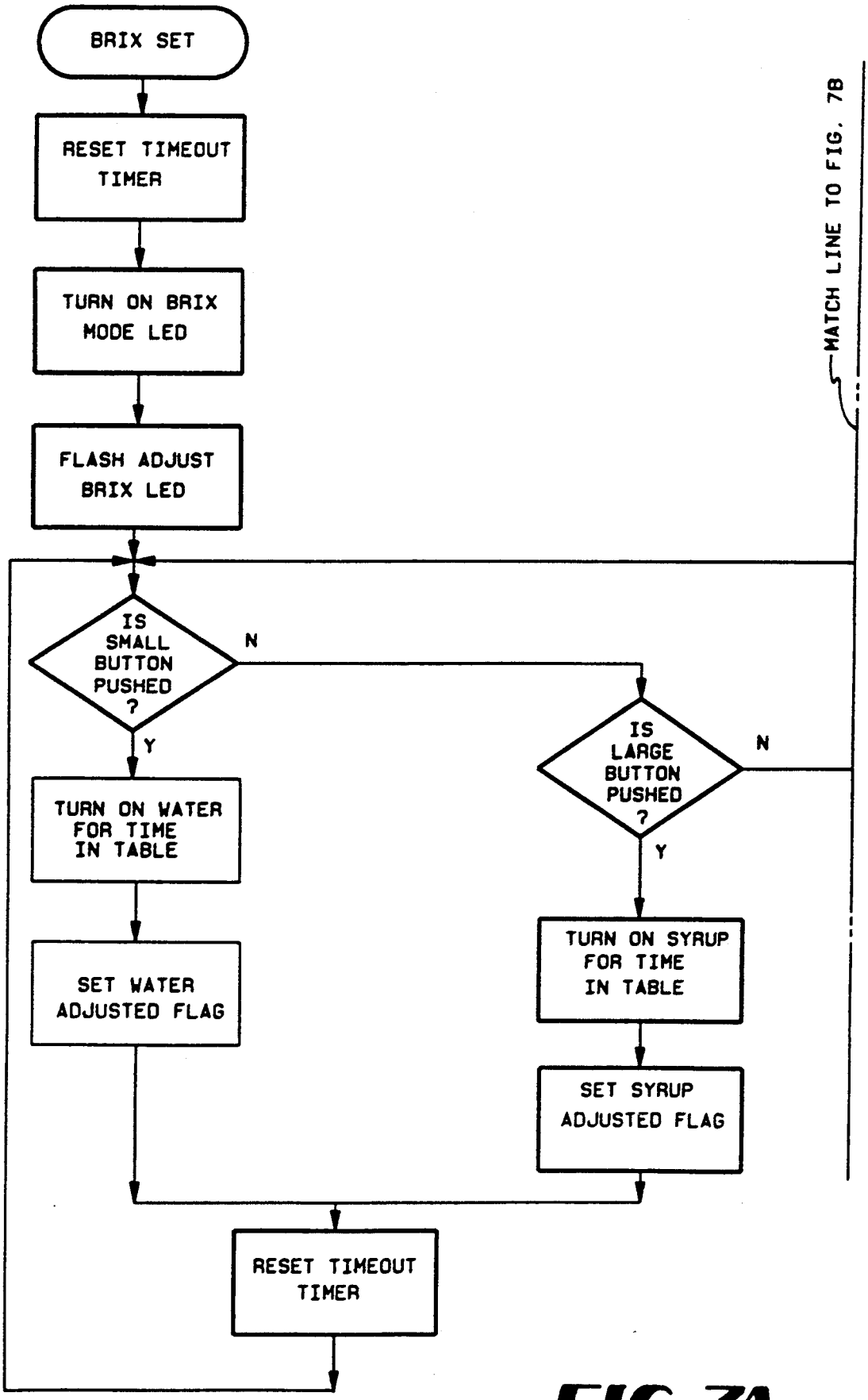
Figure 7B:
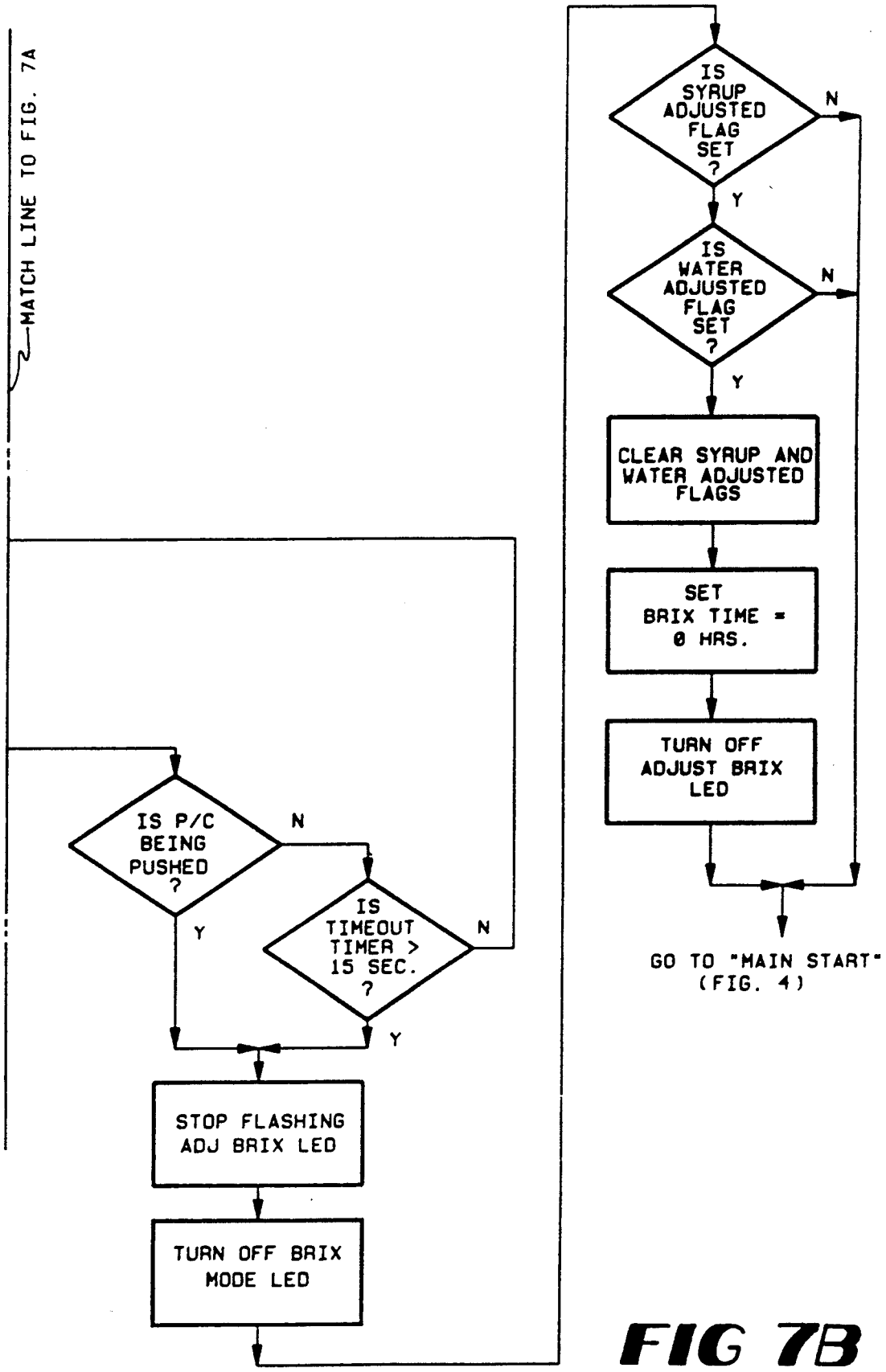

FIG. 6 shows the operation of the unit when a Small, SW6, Medium, SW7, Large, SW8, or Extra Large, SW5, switch has been pressed. In this mode, the unit turns the solenoids on for a preprogrammed time. The solenoids will be turned off after the preprogrammed time has elapsed or after the Pour/Cancel button has been pushed. In both cases control is transferred back to the main program in FIG. 4. FIGS. 7A and 7B show the operation of the unit in the brix check mode. This mode is used to adjust the ratio or brix of the valve. Control is transferred to this module from the main program in FIG. 4 when the Small, Large, and Pour/Cancel buttons are pressed simultaneously. Control is transferred back to the Main program in FIG. 4 when the Pour/-Cancel button is pushed or when there has been no operator activity for 15 seconds.

Figure 8:
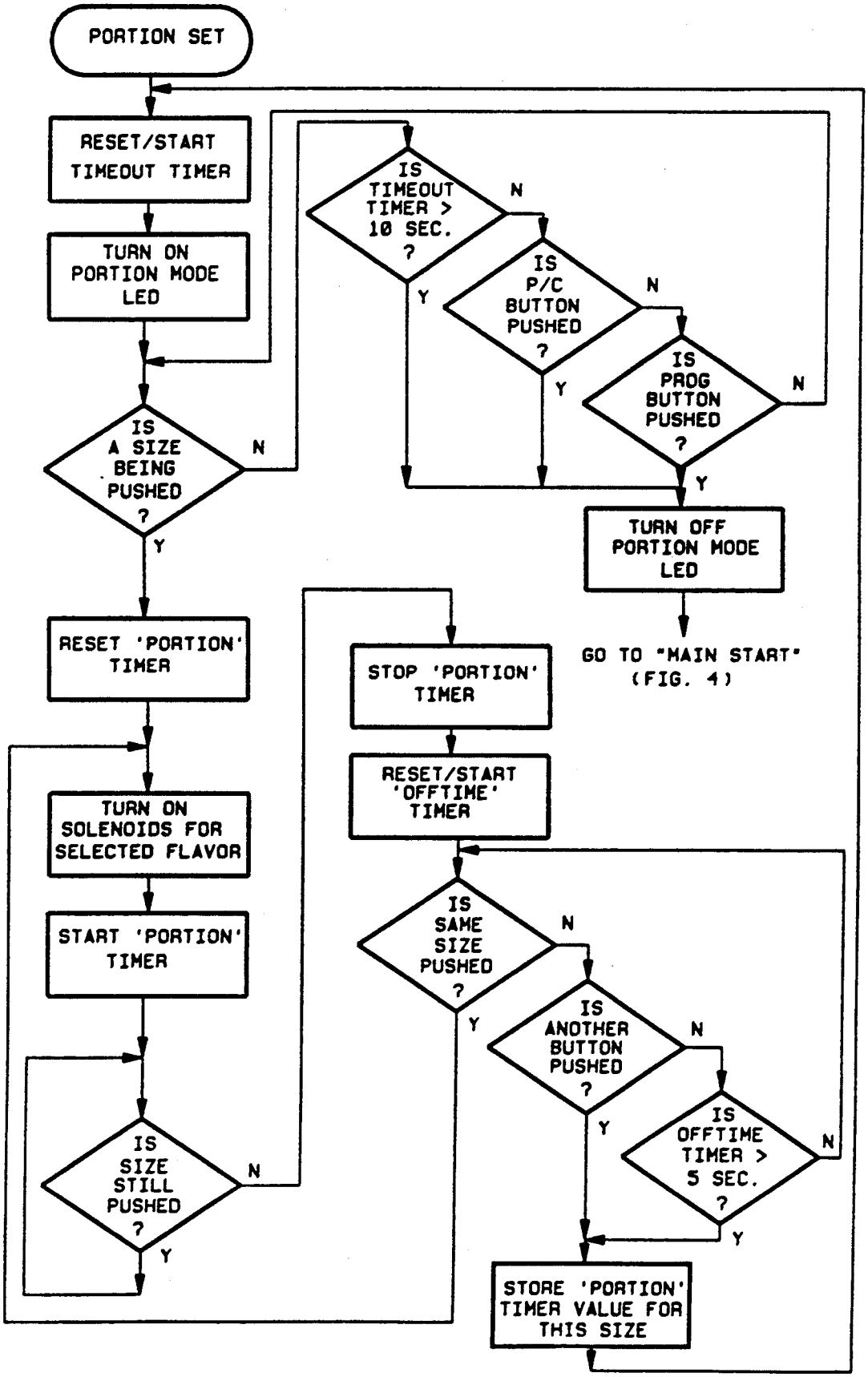

FIG. 8 shows the operation of the unit in the portion set mode. This mode is used to set the programmed pour times for each portion size. Control is transferred to this program module from the main program in FIG. 4 when the program button is pushed. Control is returned to the main program when the program button is pushed again or when 5 seconds has elapsed without operator action.

When the preferred embodiment of this invention has been described above in detail, it is to be understood that variations and modifications can be made therein without departing from the spirit and scope of the present invention.

What is claimed is:

1. In a postmix beverage dispensing valve including a valve body, a valve cover including a front panel, a water circuit through said body, a syrup circuit through said body, a water solenoid controlling flow through the water circuit, a syrup solenoid controlling flow through the syrup circuit, an adjustable water flow control, an adjustable syrup flow control, a plurality of cup size selection buttons and a Pour/Cancel button on said front panel, and a nozzel for dispensing a beverage mixture of syrup and water, the improvement comprising:

(a) a control system of easily adjusting the ratio of water to syrup;

(b) said control system including a microprocessor based control circuit mounted inside said cover;

(c) said circuit including:

(i) means for dispensing water for a predetermined period of time; and (ii) means for dispensing syrup for a predetermined period of time; and (d) a volume measuring cup having a water level mark and a syrup level mark, whereby, the water and syrup flow controls provides a means that is adjusted if the dispensed water and syrup volumes do not identically match said marks.

2. A postmix beverage dispensing valve including a valve body, a valve cover, a water circuit through said body, a syrup circuit through said body, a plurality of cup size selection buttons, a nozzle for dispensing a beverage mixture of syrup and water, a control system for adjusting the ratio of water to syrup; said control system including a microprocessor based control circuit; said circuit including: means for separately dispensing water for a predetermined period of time, and means for separately dispensing syrup for a predetermined period of time; and said control system including separate water and syrup flow controls that are adjusted if the water and syrup volumes dispensed during said respective predetermined periods of time are not equal to predetermined volumes of water and syrup respectively, whereby said control system provides a means for adjustably setting the ratio of water to syrup.

* * * * *